United States Patent [19]

Hodges et al.

[11] Patent Number: 4,651,489

[45] Date of Patent: Mar. 24, 1987

[54] INSULATED ROOFING STRUCTURE

[75] Inventors: Robert E. Hodges, Memphis; John R. Bell, III; Peter E. Helgesen, both of Germantown, all of Tenn.

[73] Assignee: AMCA International, Bowling Green, Ky.

[21] Appl. No.: 544,713

[22] Filed: Oct. 24, 1983

[51] Int. Cl.[4] ..... E04B 5/00

[52] U.S. Cl. ..... 52/409; 52/410; 52/478; 52/520

[58] Field of Search ..... 52/90, 404, 407, 408, 52/409, 410, 440, 478, 479, 483, 486, 519, 542, 287, 288, 312, 254–256, 716, 482, 762, 520

[56] References Cited

U.S. PATENT DOCUMENTS

| | | | |
|---|---|---|---|
| 1,612,644 | 12/1926 | Nicholay | 52/287 |
| 1,778,337 | 10/1930 | Pratt | 52/483 |
| 1,801,240 | 4/1931 | Schaffert | 52/489 |
| 2,000,243 | 5/1935 | Manske | 52/479 |
| 2,003,996 | 6/1935 | Finzer et al. | 52/482 |
| 2,216,319 | 10/1940 | McGee | 52/292 |
| 2,642,968 | 6/1953 | Roush et al. | 52/542 |
| 3,296,761 | 1/1967 | Varlonga | 52/409 |
| 3,373,534 | 3/1968 | Berridge | 52/90 |
| 3,401,494 | 9/1968 | Anderson | 52/309.7 |
| 3,474,583 | 10/1969 | Manias | 52/408 |
| 3,662,509 | 5/1975 | Studzinski | 52/404 |
| 3,879,911 | 4/1975 | Howells | 52/404 |
| 4,047,336 | 9/1977 | Stahlhut et al. | 52/484 |
| 4,081,938 | 4/1978 | Bertacchi et al. | 52/410 |
| 4,133,155 | 1/1979 | Oelrich | 52/372 |
| 4,149,349 | 4/1979 | Nilsen et al. | 52/410 |
| 4,213,282 | 7/1980 | Heckelsberg | 52/410 |
| 4,296,581 | 10/1981 | Heckelsberg | 52/520 |
| 4,329,823 | 5/1982 | Simpson | 52/410 |
| 4,346,543 | 8/1982 | Wilson et al. | 52/410 |
| 4,429,508 | 2/1984 | Sizemore | 52/410 |
| 4,494,343 | 1/1985 | Berry et al. | 52/410 |

*Primary Examiner*—John E. Murtagh
*Assistant Examiner*—Andrew Joseph Rudy
*Attorney, Agent, or Firm*—Burns, Doane, Swecker & Mathis

[57] ABSTRACT

An insulated roof structure includes insulating thermal elements which space attachment clips from an underlying purlin and introduce substantial thermal resistance above the purlin. Each insulating element includes a metal cap and an insulating body portion. The cap is enlarged at one end to overlappingly receive the end of an adjacent insulating block. And, the cap has a positioning device that aids accurate positioning of the overlying roof panels.

7 Claims, 7 Drawing Figures

INSULATED ROOFING STRUCTURE

BACKGROUND OF THE INVENTION

The present invention relates generally to metal roof structures for use in buildings. More particularly, the present invention concerns uniformly insulated metal roof structures.

Metal roof for use in connection with various building structures have, of course, been known for many years. Since metal is a notoriously good conductor of heat, such roofs have been thermally inefficient and the need for insulating metal roofs has long been known. Moreover, the need to insulate a metal roof is readily apparent to any occupant during the temperature extremes of summer and winter since the buildings are hard to heat in the winter and hard to cool in the summer without some type of roof insulation.

While there are many ways of insulating roof structures, one commonly employed method uses rigid or semi-rigid foamed insulation materials. A second commonly employed technique uses roll insulating material. When roll insulated material is employed, retardation of heat flow through the roof is obtained by the expanded thickness of the roll which results when it is unrolled.

A conventional metal roof construction requires placement of this roll insulation over horizontal supports or purlins with roofing panels being placed on top of the insulation and subsequently attached to the purlins. The attachment of the roof panels to the purlins creates an area where the roll insulation is compressed from its expanded thickness to a considerably smaller thickness. Typically, this compressed thickness may be in the neighborhood of one to two tenths of an inch. Since the desirable heat retardation properties are a function of the actual thickness of the insulating material, the compressed areas above the purlins are, in effect, regions where increased heat flow or heat loss occurs.

In recent years there has been a considerable emphasis on increasing the energy efficiency of buildings of all types. This emphasis is, in at least part, due to the substantially increased costs of heating and cooling buildings. The regions of increased heat flow created by the compressed roll insulation above the purlin has been a source of concern in terms of increasing the thermal efficiency of metal roof structures.

One typical metal roof construction uses roof panel mounting clips positioned above insulating material and directly attached to the purlins in order to secure roof panels to the roof structure. See, for example, U.S. Pat. No. 4,213,282, issued July 22, 1980 to Heckelsberg. Since the roof panel attachment clips are located at spaced intervals along the purlins, elongated thermal blocks are laid along the run of each purling between adjacent roof panel supporting clips. Typically, these thermal blocks have a width approximately coextensive with the width of the purlin surface and are fashioned from materials such as urethane foam or expanded styrene.

While this assembly constitutes a considerable improvement in the thermal efficiency of a roof structure, heat losses still occur in the vicinity of the roof panel mounting clips due to the compressed insulation between the roof panel mounting clip and the underlying purlin. In addition, compression of the roll insulation beneath the thermal block has a tendency to cause the thermal block to bend upwardly so that its center portion is at a higher elevation than its end portions. This distortion of the thermal block causes an effect known as "pillowing" in the overlying roof panels and becomes a significant problem when roll insulation is used in thicknesses exceeding four inches. Pillowing not only adversely affects appearance of the roof but also makes the roof panels more difficult to place and to fasten in the roof panel structure. Another deficiency of this roof structure concerns thermal block dislocations. Since the roof panels expand and contract in response to ambient temperature variations, the panel movement may cause the thermal block to be dislocated from its overlying relationship with the purlin. In this event, the additional insulating value of the thermal blocks can be lost or substantially diminished.

Another problem in construction of insulated metal roof assemblies concerns the difficulty of placing roof panel attachment clips above the insulation. These clips must not only be properly spaced but also must be attached to the purlin in a secure manenr. In the past, spacing between clips was usually measured. As a result, it was a cumbersome and time consuming procedure to mount the clips to the purlins on top the roll insulation. Moreover, the problem of clip attachment is compounded as the thickness of the roll insulation increases causing the roof panels to distort due to the upward pressures of the insulation.

In one attempt to compensate for the problem of insulation compression above a purlin, it has been proposed to employ generally U-shaped brackets, placed over the purlins to support insulating materials between adjacent purlins. A strip of insulating material is then placed above the bracket. Roof panels are attached to the purlin by fasteners which pass directly through the insulating strip and into the purlin. See, for example, U.S. Pat. No. 4,346,543, issued Aug. 31, 1982 to Wilson et al; and U.S. Pat. No. 3,662,509 issued May 16, 1972 to Studzinski.

In an insulated metal wall structure having surfaces of corrugated metal and batts of insulation positioned therebetween, it has also been proposed to employ a spacer block of foamed insulating material such as polyurethane. The spacer block is provided with one or two metal facing plates for the purpose of spacing the walls from one another. One end of the space block may have a pair of leg portions each of which engages convolutions of an adjacent wall such that a crest of the wall is received by a groove between the legs. See, for example, U.S. Pat. No. 3,474,583 issued Oct. 28, 1969 to Manias.

A heat insulating structural member is also known in which a heat insulating core having a height substantially exceeding its width is provided with a pair of U-shaped caps made of metal like aluminum are provided on the top and bottom edges of the insulating material core to complete the structural member. Other patents of more general interest are U.S. Pat. No. 3,373,534 issued Mar. 19, 1968 to Berridge and U.S. Pat. No. 3,879,911 issued Apr. 29, 1975 to Howells.

The various prior art devices do not show a solution to the problems of the thermal short circuit resulting from compression of the roll insulation, the movement of a thermal block caused by improper placement or thermal expansions and contractions and pillowing resulting from forces exerted by the compressed insulation material. Moreover, there is not teaching of a method of attaching the roof support clips to their proper predetermined positions along purlins.

SUMMARY OF THE INVENTION

In accordance with the present invention, an insulating element is provided for use in connection with metal roof and wall constructions which overcomes the problems noted above. The insulation element includes a cap over an elongated body of insulating material which material has a width that is substantially greater than its depth so as to be stable against overturning. The insulating element has a metal cap arranged to stiffen the element against bending in a vertical plane passing through the purlin. In this fashion, the insulating element avoids the pillowing problem associated with known prior art devices. In addition, the metal cap is provided with a positioning means to which roof panel mounting clips can be attached. Accordingly, each roof panel mounting is spaced from the purlin by the element and has the same insulation charcteristics as the remaining portion of the roof structure extending along the purlin.

The length of the metal cap exceeds the length of the body portion. One end of the cap projects beyond the body portion and is enlarged sufficiently to receive the adjacent end of a endwise adjacent insulating element. With this arrangement, a continuous layer of insulating material in the body portion of the insulating elements can be provided above the purlin and continuously along its entire length.

The length of the body portion of insulating material is selected to be an integral multiple of the roof panel widths. In this fashion, the positioning means can be located at a predetermined distance along the length of the metal cap so that the roof panels will be properly positioned in the structure.

In the event that it is desired to increase the thickness of roll insulation between the purlins, one or more additional layers of roll insulation can be positioned above the insulating elements prior to placement of the roof panel support clips and the roof panels themselves. Since the positioning means may also be provided with the ability to penetrate roll insulation material, the roof panel attachment clips can also be placed on top of these additional layers of roll insulation.

The element may include a groove on the bottom which is sufficiently wide to recieve the top of a purlin and the compressed thickness of a layer of roll insulation. With this arrangement, the groove provides additional retraint of the element against dislocation relative to the purlin.

BRIEF DESCRIPTION OF THE DRAWINGS

Many objects and advantages of the present invention will be apparent to those skilled in the art when this specification is read in conjucntion with the attached drawings wherein like reference numerals are applied to like elements and wherein.

DESCRIPTION OF THE PREFERRED EMBODIMENT

Figure 1:
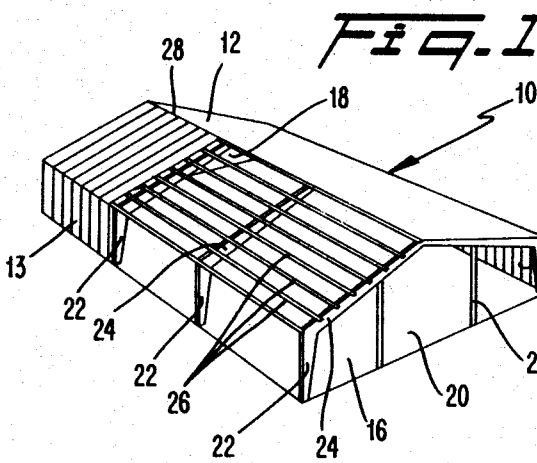
FIG. 1 is a perspective view with portions broken away of a metal building structure of a type for which the insulated metal roof structure of the present invention is suitable.

A building 10 (see FIG. 1) has a low profile roof structure 12 which covers a volume surrounded by sidewalls 13, 14, 16, 18 and which overlies a floor 20. The sidewalls 13, 14, 16, 18 may be of any suitable conventional construction. The present invention, however, is particularly well suited for use in connection with structures where the sidewalls are fabricated from the metal panels that are joined together with vertically extending joints. Disposed around the periphery of the floor 20 are a plurality of frame columns or vertical members 22. These columns 22 provide support for rafters 24 which comprise beams that support the roof 12 above the lateral span of the volume enclosed by the building 10.

Extending longitudinally along the building 10 and supported by the rafters 24 are a plurality of generally horizontal parallel supports or purlins 26. These purlins are spaced from one another along the underlying rafters 24 by a generally uniform distance, typically in the neighborhood of four to five feet. Each purlin is securely attached to the underlying rafter 24. The purlins 26 underlie the entire roof structure 12. The covering of the roof 12 is assembled from a plurality of substantially identical roof panels each of which extends transversely of the purlins 26 from the ridge 28 to the adjacent sidewall 13, 14. Adjacent parallel edges of the roof panels 28 are joined together in a well known manner in a direction extending along the pitch of the roof. For example, see U.S. Pat. Nos. 4,213,282 and 4,296,581 issued on July 22, 1980 and Oct. 27, 1981, respectively, to Heckelsberg.

Each roof panel 30 of a standing seam roof (see FIG. 2) is attached to the purlins 26 and simultaneously insulated in accordance with the present invention. More particularly, one edge 32 of each roof panel 30 is connected by a roof panel attachment clip 34 to each purlin 26. Thus, extending along the edge 32 of the roof panel 30 of a roof panel attachment clip 34 is provided for each of the purlins 26.

The roof panel mounting clip 34 is positioned with respect to an insulation element 36 which extends along the length of the underlying purlin 26. If desired, a supplemental layer of roll insulation 38 may overlie the insulation element 36 before the roof attachment clip 34 is attached.

Primary insulation of the roof structure is obtained by a layer of roll insulation 40 which is compressible and which extends between adjacent purlins in the direction running between the ridge and parallel sidewalls. In the vicinity of the purlin 26, the primary insulation 40 is compressed by the presence of the insulating element 36 while the roof panel attachment member 34 is secured to the purlin.

Figure 3:
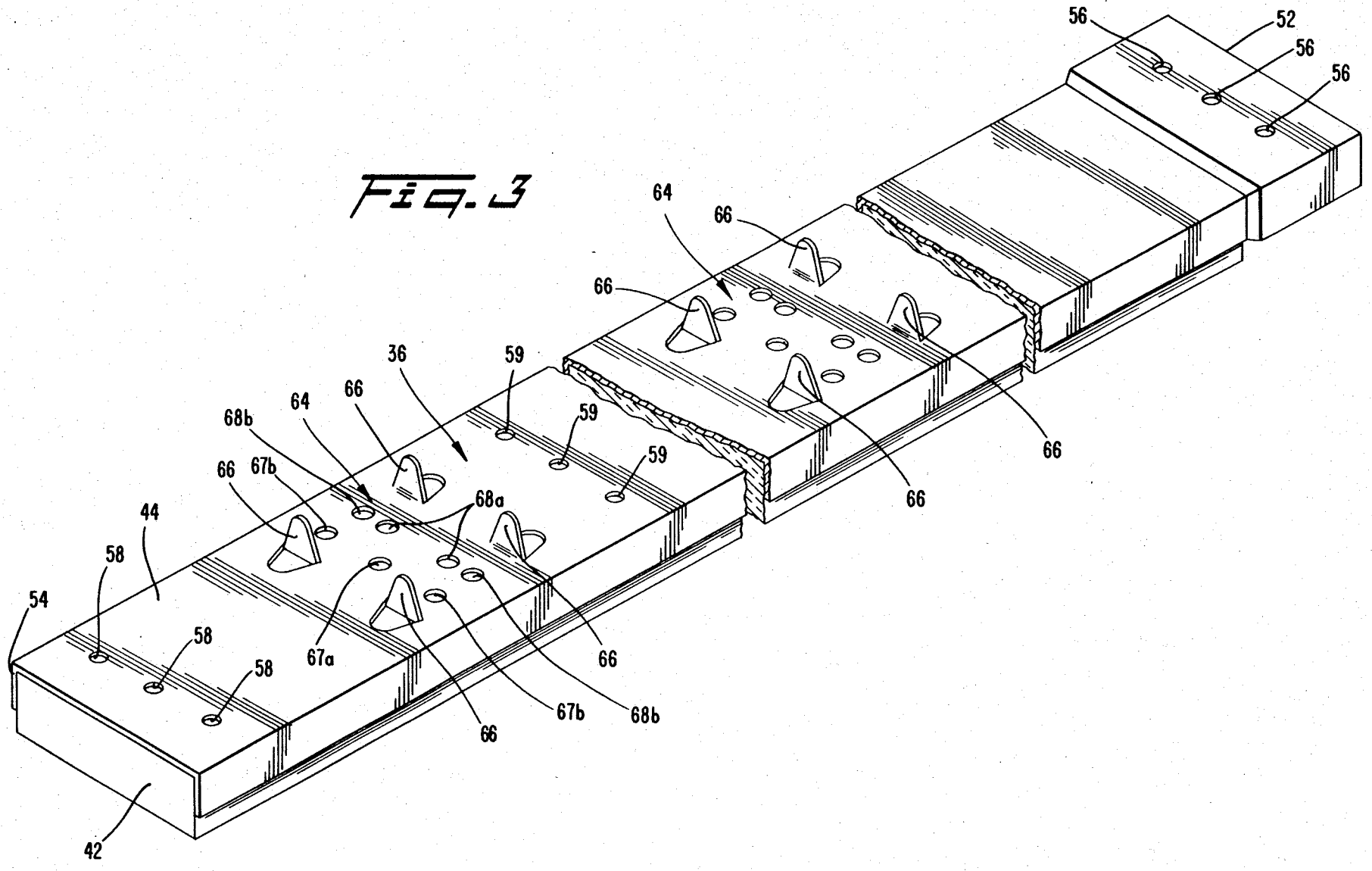
FIG. 3 is a perspective view of an insulating element in accordance with the present invention with some portions removed so that details can be shown.

Turning now to FIG. 3, the insulation element 36 includes a body portion 42 and a cap portion 44. The body portion 42 is elongated and has a length which is selected to correspond to the width of the roof panels which are mounted transversely to the purlins. If desired, the length of the body portion 42 may be selected to be an integral number of roof panel widths. With this arrangement, the elongated body portions may be placed in end-to-end relationship along a purlin such that the roof panel joints will occur at the same position on the insulating element 36. Preferably, the body portion is fabricated from a rigid type insulation material, such as expanded styrene or foamed urethane, in order to introduce a substantial resistance to the flow of heat across the insulation element 36.

Figure 6:
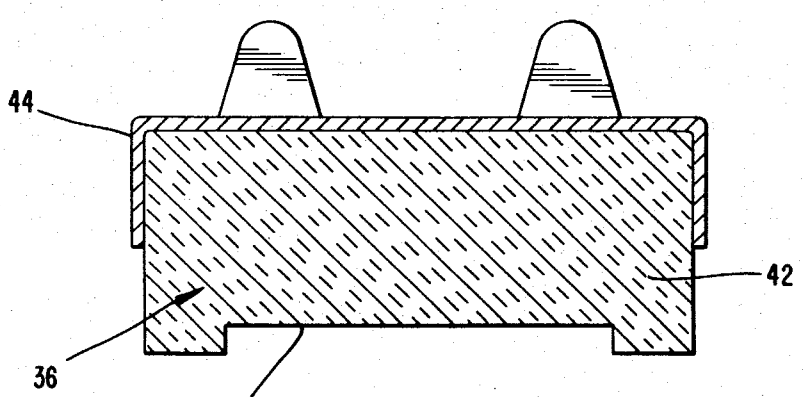
FIG. 6 is a view similar to FIG. 5 of a modified insulating element.
Figure 5:
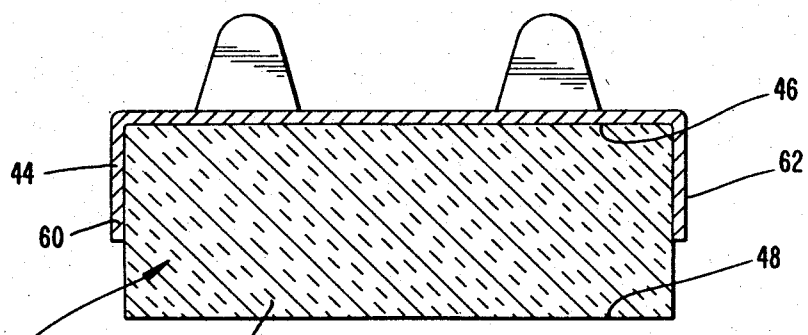
FIG. 5 is an enlarged cross-sectional view taken along the line 5—5 of FIG. 4.

The body portion has a vertical height which is substantially less than its horizontal width (see FIG. 5). The body portion 42 also includes an upper surface 46 and a lower surface 48, the height being measured between the top and bottom surfaces 46, 48. This bottom surface 48 may, if desired, have a longitudinally extending groove 50 (see FIG. 6) along the entire length thereof which is recessed upwardly away from the bottom surface 48. That groove 50 has a width which exceeds the width of a purlin by a distance sufficient to accommodate twice the compressed thickness of the primary insulation material. In addition, the groove 50 has a depth which exceeds the compressed thickness of a layer of roll insulation. With this arrangement and proportioning for the groove 50, the insulation element 36 can tightly compress the primary insulation layer 40 against the purlin and still have the ability to substantially retard any tendency of the insulation element to become misaligned with respect to the underlying purlin.

Attached to the top surface 46 (see FIG. 5) of the body portion 42 is the cap 44. As noted, the cap 44 may be fabricated from metal such as galvanized steel. This cap 44 is considerably longer than the underlying body portion 42 (see FIG. 4) such that a first end 52 projects beyond a corresponding end of the body portion 42. The second end 54 of the cap 44 is substantially coplanar with the end of the body portion 42.

The first end 52 of the metal cap 44 is enlarged in a suitable conventional manner, such as by swaging, sufficiently to receive the second end 54 of an endwise adjacent insulation element 36 (not shown). By enlarging the first end 52, the second end of the body portion of an endwise adjacent insulation element 36 can move into abutting relationship with the first end of the insulation element 36 (which is recessed from the first end 52 of the metal cap 44). This abutting relationship is also important to assure proper positioning of attachment clips for the roof panels.

In order to attach the insulation elements 36 to the underlying purlin, and to simultaneously attach the insulation elements to one another, the first end 52 of the metal cap 44 is provided with one or more aperture 56. The axis of each aperture 56 is spaced from the end of the underlying body portion 42 by a predetermined distance, for example, approximately one half the longitudinal length of the swaged portion. One or more corresponding apertures 58 are located at the second end 54 of the insulation element 36 and extends through both the body portion 42 and the cap 44. The centerline or axis of each second aperture 58 is spaced from the second end 54 of the insulating element 36 by the same predetermined distance that the axis of the aperture 56 is spaced from the corresponding end of the body portion 42. Accordingly, when endwise adjacent insulation elements 36 are in proper relationship to one another, each aperture 56 will be in alignment with each second aperture 58 of an endwise adjacent insulating element. Thus, by inserting a suitable conventional fastener through the aligned apertures 56, 58 the insulation elements 36 can be securely jointed to an underlying purlin. It will, of course, be apparent to those skilled in the art that it is possible to simply join endwise adjacent insulating elements 36 to one another using the aligned apertures 56, 58 of corresponding insulting elements 36 without simultaneously attaching the insulating elements to the purlin.

One additional set of apertures 59 is preferably provided along the insulation element. That spacing is preferably about 80 percent of the distance between the apertures 56, 58 along the element 36. In this fashion, when the swaged end 52 of an element is attached to an adjacent element, an additional fastener can be connected at one of the apertures 59 to precisely align and retain the element 36 in its desired position.

Figure 4:
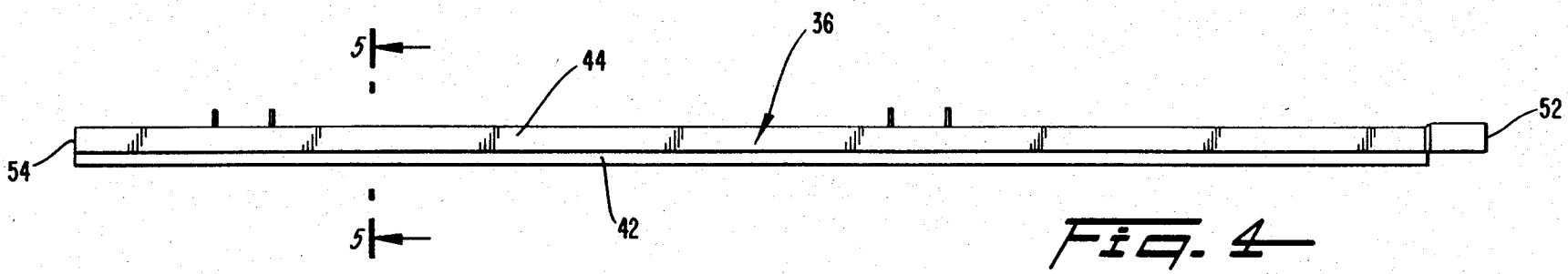
FIG. 4 is a side elevational view of the insulating elements in reduced scale.

The cross-sectional shape of the cap 44 (see FIG. 5) is selected so that the cap 44 will significantly resist bending in the vertical longitudinal plane which passes through an underlying purlin and which corresponds generally to the plane of FIG. 4. In particular, a generally U-shaped configuration (see FIG. 5) is provided for the metal cap 46. With this U-shaped configuration, the cap 44 has a pair of generally parallel sides 60, 62 which have a depth substantially less than the height of the body portion 42. In this manner, the sides 60, 62 of the cap 44 do not establish a thermally conductive path between the bottom surface 48 and the top surface 46 of the insulating body portion 42. Other cross-sectional shapes are also within the purview of this application. For example a C-shaped cross-section is possible where the body portion is received in the opening but where the sides are only engaged by edges of the cap.

In order to position the roof panel attachment clip with respect to the underlying purlin, each insulating element 36 (see FIG. 3) includes an alignment means 64 along the top surface thereof. Preferably, the alignment means 64 is in the metal cap portion 44. The alignment means 64 is used to position the roof panel attachment clip without requiring the installer to locate openings that may be positioned in a purlin beneath several inches of insulating material.

The alignment means 64 may comprise a plurality of relatively sharp tabs 66 which are stamped out of the metal of the cap 44 and bent so as to project vertically upwardly therefrom. Each tab may be generally triangular with a rounded end. Preferably two tabs 66 will be in transverse alignment with one another and a second pair of traversely aligned tabs 66 will be spaced from the first two tabs 66 by a distance sufficient to accommodate the base of the roof panel attachment clip 34 (see FIG. 2). The tabs 66 (see FIG. 3) project vertically upwardly by a distance greater than the compressed thickness of any one or more layers of roll insulation material that may be placed above the insulating elements 36. Since the tabs 66 will thus project through the roll insulating material, the tabs 66 will permit positioning of the roof panel attachment clip regardless of whether or not supplemental layers of roll insulation are used. In addition to the alignment tabs 66 the insulating element 36 has two rows of predrilled vertical holes 67, 68 in the region bounded by the tabs 66. These holes 67, 68 are provided to receive fastening elements which connect the roof panel attachment clips directly to the purlins. A center cluster of holes **67*a*, 68*a* is adapted to connect the attachment clip to a purlin 3. Where the roof uses bar joists instead of purlins, the center hole 67** would often be aligned with a space; accordingly, the outer cluster of holes *67b, 67b* eliminates that spacing so that the element can be used both with purlin construction and bar joist construction.

Figure 2:
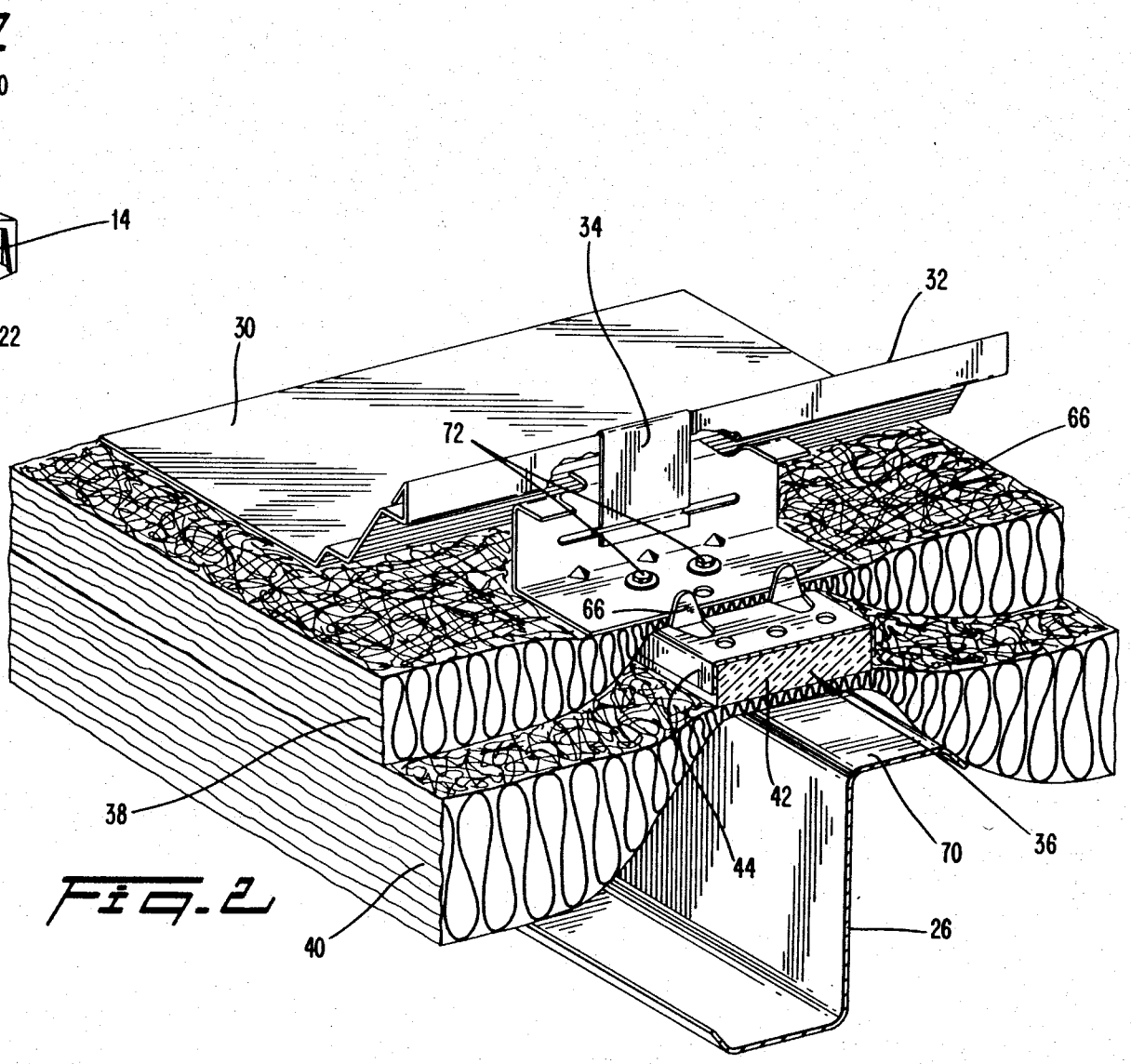
FIG. 2 is an enlarged perspective view in partial cross section of the insulating roof structure with portions broken away to illustrate the assembly.

With the foregoing description, the assembly and construction of a roof structure utilizing the insulation elements 36 of the present invention can be better appreciated (see FIG. 2). When the purlins 26 have been positioned and attached in the roof structure, the primary insulation layer 40 is unrolled in the direction transverse to the longitudinal extent of the purlins 26. Accordingly, the primary insulation 40 expands to its uncompressed height. The insulating elements 36 are then positioned above the purlins 26.

In positioning the first insulating element 36, the attachment means 64 is positioned for the first roof panel on each purlin, the second end 54 of each element extending toward the roof portion remaining to be covered. A fastener is then connected through one of the holes 59 to fix the position. The primary insulation layer 40 is compressed between the bottom 60 of the insulating element 36 and the top flange 70 of the purlin 26. As a result, the insulation element 36 is securely connected to the purlin 26 in an essentially fixed alignment therewith.

For an installation where an additional layer of roll insulation is required or desirable, a supplemental insulation layer 38 is unrolled over top of the insulation elements 36 and the primary insulation 40. When it becomes time to attach the roof panel attachment clips 34, the secondary insulation layer 38 is pressed down on the locater tabs 66 which then protrude therethrough and indicate the proper position and alignment for the roof panel attachment clip 34. The threaded fasteners 72 are then attached as described above.

The standing seam roof panels 30 can then be attached to roof panel attachment clips 34 in the manner described for example in the Heckelsberg U.S. Pat. Nos. 4,213,282 and 4,296,581 which are incorporated herein by this reference thereto.

To place the next roof panel, an attachment clip is simply positioned between the next spaced pair of tabs 66 and attached to the corresponding purlin. An attachment clip is provided for each panel at each purlin. Moreover, the attachment clip can be located by simply feeling the tab location on the underlying insulation element even if the tabs 66 are covered by a second layer of roll insulation 38.

When the available attachment points 64 of an insluating element have been used, the primary roll insulation 40 is then extended along the purlins and another insulating element is positioned on each purlin such that the apertures 56 of its swaged end 52 are in vertical alignment with the apertures 58 of the second end of the previously installed insulating element. A fastener then attaches the insulating element 36 to the purlin through one of the aligned apertures. A second fastener is then connected to the purlin at one of the apertures 59 near the second end, thereby holding the insulating element in its desired relationship to the purlin. Roof panel placement and further insulation then proceed as described.

Figure 7:
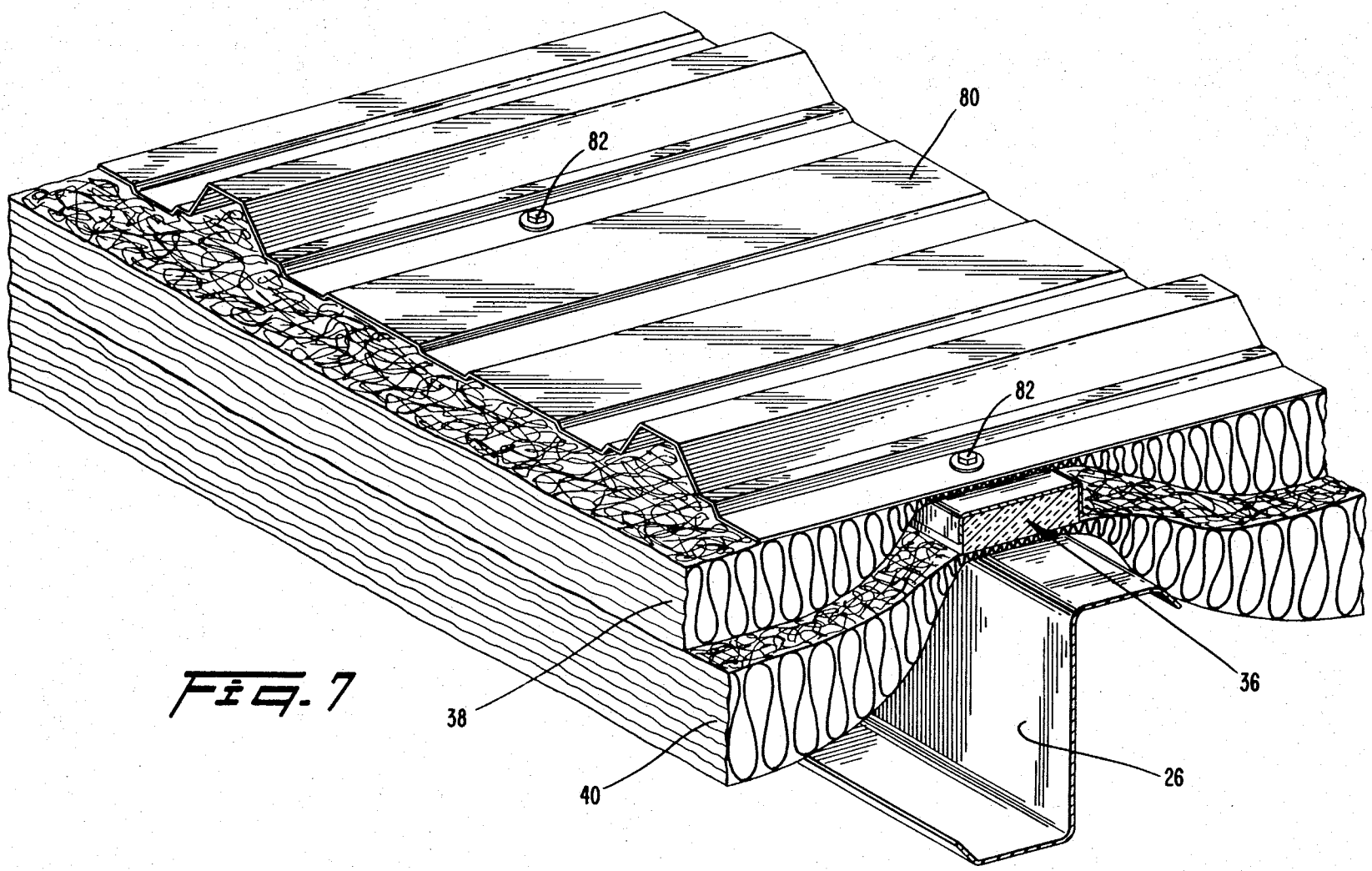
FIG. 7 is a view similar to FIG. 2 of a corrugated roof using the insulating element.

In structures which use corrugated panels 80 (see FIG. 7) for either roof or wall construction, the insulating element 36 can also be used effectively to reduce heat losses. In corrugated panel construction, the tabs 66 (see FIG. 3) are bent back into the top surface plane of the cap 44 or, during fabrication, are left off. The threaded fasteners 82 (see FIG. 7) are then attached directly to the purlin or other frame element.

It will now be apparent that the metal cap 44 on the insulation elements 36 prevents that insulation element from pillowing up under the effect of the primary insulation layer 40. As a result, distortion of the roofing panel 30 and across its width is significantly reduced and placement of the roof panel attachment clips 34 is facilitated. In addition, it will be apparent that the presence of the insulation element 36 creates a substantial and generally uniform thermal resistance between the roof panel 30, the attachment clip 34 and the purlin 26. This additional substantial thermal resistance prevents the establishment of thermal short circuits through the roof structure.

Moreover, when it is necessary or desirable to add supplemental roll insulation to the roof structure, the additional roll insulation can be added above the insulation elements 36 without deleteriously affecting construction of a roof structure.

Since each insulation element 36 includes an integral number of at least two locator means 64, erection of standing seam roof structures is greatly accelerated. More particuarly, the installation team is not required to measure for each attachment clip: a task which is difficult where expanded roll insulation interferes with direct measurement. Moreover, since each insulation element 36 is precisely positioned relative to the longitudinally adjacent insulation element by virtue of the aligned holes 56, 58, once the first element is properly positioned on a purlin, all subsequent roof panel attachments clips are correctly located on that purlin.

Still further, when the insulation element 36 has a groove which cooperates with the purlin flange 70 so that the flange itself is contained in the groove along with compressed insulation, the insulation element 36 is effectively prevented from lateral dislocation during assembly and during later use.

It should be also noted that the depth of the insulation element 36 is substantially less than the width of the insulation element. This physical relationship is important since it provides a greater stability to the insulated roof structure and resists any tendency of the roof panel mounting clips 34 to twist off the underlying flange 70.

It should now be apparent that there has been provided in accordance with the present invention an insulating block and insulated roof assembly which overcomes problems of the type discussed above in connection with the prior art. Moreover, it will be apparent to those skilled in the art that numerous modifications, variations, substitutions and equivalents exist for features of the invention which do not materially depart from the spirit and scope thereof. Accordingly, it is expressly intended that all such modifications, variations, substitutions and equivalents which fall within the spirit and scope of the invention as defined in the appended claims be embraced thereby.

What is claimed is:

1. An insulation element for use in metal building construction comprising:

an elongated body portion having a width, a top, a bottom and a height between the top and bottom less than the width for stability against overturning, and being made from thermal insulating material; and a structural cap substantially covering the top of the body portion, having a cross-sectional configuration arranged to stiffen the insulating material body portion against transverse bending in a plane substantially perpendicular to the top and bototm while avoiding creation of a heat transfer path across the body portion, the cap including:

an end extending beyond the body portion and being sufficiently enlarged to accept an adjacent end of an endwise adjacent insulation element so that essentially continuous stiffening is provided along piecewise continuous insulating material; and a plurality of alignment means spaced along the cap at a predetermined interval for positioning the cooperating structure of a roof; and the elongated body portion having a length which is an integral multiple of the predetermined interval.

2. The insulation element of claim 1 wherein the cap is fabricated from metal.

3. The insulation element of claim 1 wherein the alignment means includes a plurality of positioning tabs spaced at the predetermined interval along the cap.

4. An insulated roof structure comprising:

a plurality of generally parallel supports;

a plurality of generally parallel surface elements arranged to lie substantially perpendicular to the longitudinal underlying supports;

a plurality of connectors, each attached to surface elements;

compressible insulation means for retarding heat flow across the roof structure, underlying the surface elements, being supported by the generally horizontal underlying supports, being compressed at the underlying horizontal supports;

insulation elements arranged in end-to-end relationship along the parallel supports above the insulation means, each insulation element including:

a body portion of insulating material, having a bottom surface supported by the underlying parallel support, and having a width and a depth, with the width substantially exceeding the depth for stability against overturning;

a structural cap having a first end, a second end and alignment means for positioning a corresponding connector, the first end extending beyond the underlying insulating material body portion and being sufficiently enlarged to receive the second end of an endwise adjacent insulation element, the cap having:

a cross-sectional configuration arranged to stiffen the body portion against bending in a vertical plane extending through the underlying support;

a plurality of alignment means spaced along the cap at a predetermined interval for positioning surface elements along the underlying supports;

the elongated body portion having a length which is an integral multiple of the predetermined interval; and attachment means extending from the connectors to the supports, for securing the connectors to the supports such that the insulation elements are spaced from the supports by compressed insulation means and such that the insulation elements substantially avoid pillowing of the surface elements.

5. The roof structure of claim 4 wherein the cap of each insulation element is metal, has a generally U-shaped cross section, and is swaged at its first end.

6. The roof structure of claim 5 wherein the alignment means comprises a plurality of upstanding tabs spaced to accommodate the corresponding connector.

7. The roof structure of claim 4 further including a second insulation means, positioned between the connectors and the insulation elements for further retardation of heat flow across the roof structure.

* * * * *